United States Patent [19]

Garrett

[11] Patent Number: 4,797,955

[45] Date of Patent: Jan. 17, 1989

[54] COMBINATION PANT AND SKIRT GARMENT

[76] Inventor: Alfred G. Garrett, Box 5956, Hilton Head, S.C. 29938

[21] Appl. No.: 76,344

[22] Filed: Jul. 22, 1987

[51] Int. Cl.[4] ..... A41D 1/14

[52] U.S. Cl. ..... 2/213; 2/212; 2/71

[58] Field of Search ..... 2/212, 213, 71, 72, 2/214, 211, 227; 450/95, 105

[56] References Cited

U.S. PATENT DOCUMENTS

| | | | |
|---|---|---|---|
| 2,138,230 | 11/1938 | Friedman . | |
| 2,255,143 | 9/1941 | Alexander | 2/71 |
| 2,358,113 | 9/1944 | Solomon . | |
| 2,398,537 | 4/1946 | Koret . | |
| 2,700,771 | 2/1955 | Fluk | 2/212 |
| 2,758,312 | 8/1956 | Goldstein | 2/212 |
| 3,164,843 | 1/1965 | Erteszek | 2/212 |
| 3,315,274 | 4/1967 | Roody | 2/212 X |
| 4,069,513 | 1/1978 | Shiller et al. | 2/212 X |
| 4,091,468 | 5/1978 | Wong et al. | 2/212 |
| 4,247,959 | 2/1981 | Rose | 2/212 |

*Primary Examiner*—Louis K. Rimrodt
*Assistant Examiner*—Judith L. Olds
*Attorney, Agent, or Firm*—Foley & Lardner, Schwartz, Jeffery, Schwaab, Mack, Blumenthal & Evans

[57] ABSTRACT

A garment having a pant-like portion and a skirt-like portion is provided. The pant-like portion includes a crotch section which passes between the legs of the wearer when the garment is worn and the skirt-like portion is adapted to encircle the legs of the wearer. Both portions serve as the outermost material of the garment so that the garment has a pant-like appearance above the crotch and a skirt-like appearance below the crotch. The crotch section can be provided with a device for adjusting the snugness of fit of the crotch. The garment can include material attached to the pant-like portion which extends above the waist of the wearer and gives the garment an overall dress-like appearance. The skirt-like portion can be constructed with various hemline lengths and can be provided with a panel passing between the legs of the wearer.

10 Claims, 2 Drawing Sheets

COMBINATION PANT AND SKIRT GARMENT

BACKGROUND OF THE INVENTION

The present invention relates to an outer garment, and more particularly, to an outer garment constructed of a pants portion above the crotch and a skirt portion below the crotch. The pant and skirt portions are connected to one another to provide an attractive outer garment. The pants portion provides the wearer with increased freedom of movement and a wider choice of sitting positions than a conventional skirt or dress. Previously, garments have been proposed which have both pant-like and skirt-like features. One such garment is a culotte. The culotte generally comprises an outer skirt or dress portion which encloses two inner, pantleg-like constructions. The pantleg-like constructions are comprised of generally loose fitting fabric which hangs beneath the wearers crotch and is sewn along its front and back edges to the inside of the outer skirt portion.

Other types of garments have been proposed, such as full-length dresses, which enclose a pair of pants which are connected near their waistline to the inside of the skirt. While these garments have enjoyed some degree of fashion popularity, a garment having a pants portion as well as a skirt portion which both function as the outer garment has not yet been proposed. Such a garment would offer the flexibility of movement and relaxation of pants while incorporating the attractiveness and comfort of a skirt.

SUMMARY OF THE INVENTION

The principal objects of the present invention are to provide a garment having the desired characteristics of a pants portion around the wearer's hips and extending at least to the crotch and a skirt portion extending over the wearer's legs; having a comfortable, possibly close fitting construction in its upper portion while providing flexibilty and movement in the lower portion of the garment; and which allows the wearer to assume a number of sitting or reclining positions without fear of embarassing revelations while still preserving the attractiveness of a skirt or dress.

In accomplishing the foregoing objects, there has been provided according to the present invention a garment comprising a first portion extending upward from the crotch comprising a crotch section which passes between the legs of the wearer when the garment is worn; and a second portion connected to said first portion and adapted to encircle the legs of the wearer when the garment is worn, whereby said first and second portions are adapted to serve as the outermost material of the garment so that the garment has a pant-like appearance above the crotch and a skirt-like appearance below the crotch.

In a preferred embodiment, the second portion defines a single, unbroken interior which accommodates both legs of the wearer.

In a preferred embodiment, the garment comprises a pants portion constructed in the same manner as a pair of pants and extending from the waist to at least the crotch and a skirt portion below the crotch and extending downward over the legs. The pant and skirt portion are easily constructed from two fabric halves, with a preferable arrangment of two crotch parts which are connectable to one another.

These and other objects of the invention will be apparent as the following description proceeds in particular reference to the application drawings.

DETAILED DESCRIPTION OF THE PREFERRED EMBODIMENTS

Figure 2:
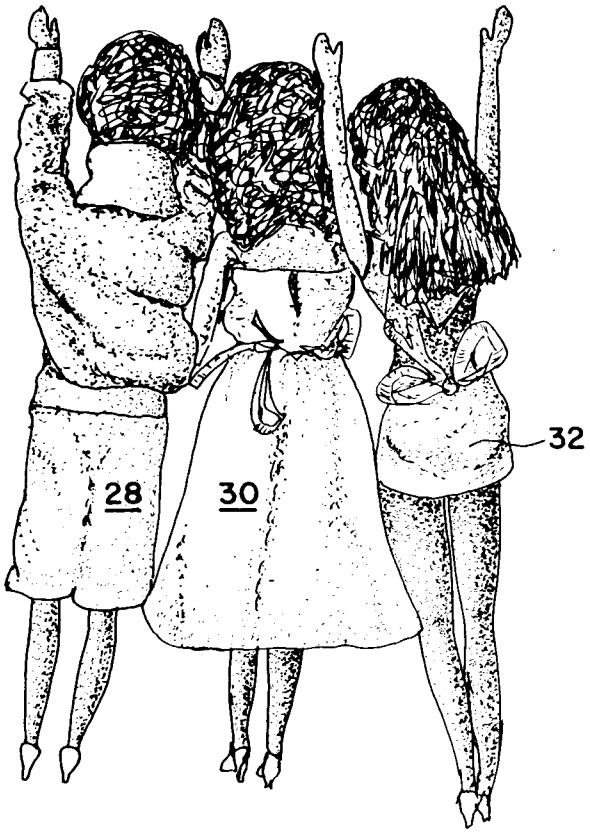
FIG. 2 is a rear view of the garments shown in FIG. 1.
Figure 1:
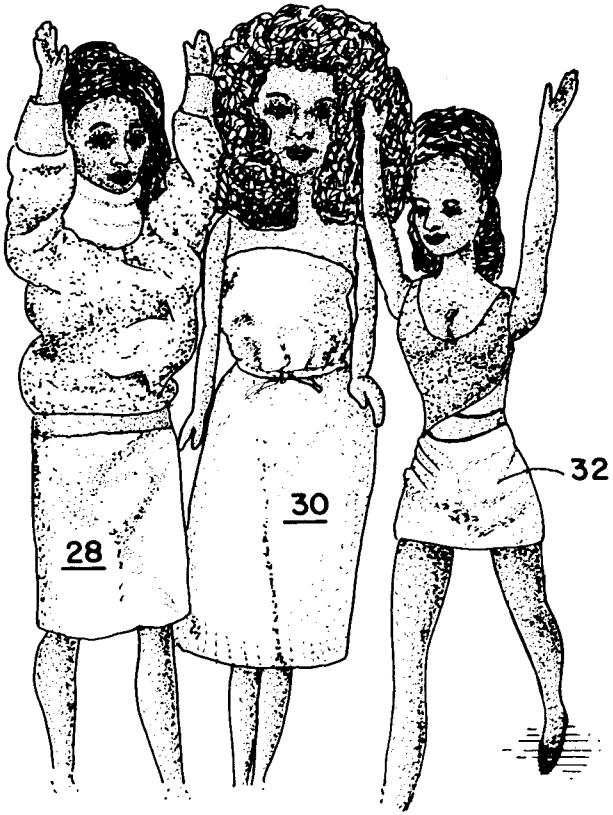
FIG. 1 is an environmental front view of three garments of the present invention shown modeled on dolls.

Referring to FIG. 1, the garment of the present invention is shown in three embodiments 28, 30 and 32. FIG. 2 shows the garments of FIG. 1 as viewed from the rear. Although garments 28, 30 and 32 are shown as modeled on dolls, it will be understood that the garments can be appropriately dimensioned for use by humans.

Figure 3:
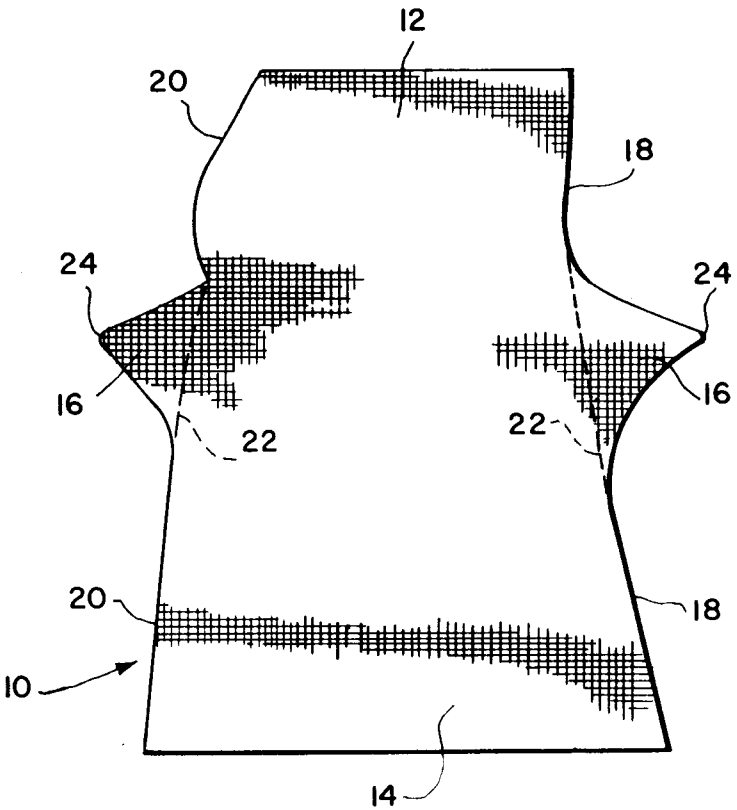
FIG. 3 is a perspective top view of a fabric cut in a pattern to form one-half of a garment of the present invention.

Referring now to FIG. 3, a garment half 10 is shown which is adapted to be connected to another garment half 10 to form a complete garment. Garment half 10 includes a pants portion 12 and a skirt portion 14. A pair of crotch parts 16 are formed on either side of garment half 10.

Garment half 10 is adapted to be connected by sewing or other connection means to another garment half 10. The garment halves 10 are joined along their respective front seams 18 and back seams 20. The respective seams 18 and 20 joined to one another below crotch parts 16 form a skirt-like portion which can define an unbroken interior in which both legs of the wearer are accommodated or which can be provided with a panel or other material passing between the legs of the wearer and connected along the inside of the front and back of the skirt-like portion. Also, crotch parts 16 are designed to be folded inward towards each other along fold lines 22 so that the outermost tips 24 of each crotch part 16 can be connected to one another to form the crotch of the garment. Fold lines 22 are arranged so that the two connected garment halves 10 have a smooth, continuous appearance when connected to one another. For this reason, fold lines 22 lie on imaginary lines extending from front seam 18 and rear seam 20.

It will be understood that crotch parts 16 can be connected to one another by sewing, stapling, gluing, securing by grommets or by other connection devices such as hooks, snaps, zippers, pins, clips. Additionally, the connection devices can be selected so that the respective crotch parts 16 can be disconnected from one another, which may be useful in adapting the garment for sanitary or washing purposes.

It will also be understood that crotch parts 16 can be aligned in various manners so as to construct garments having varying degrees of fit. For example, tips 24 of crotch part 16 can be overlapped side by side or can be overlapped top to bottom. Also, each tip 24 can be inserted into one end of a device such as a spindle which, when operated by the wearer, would vary the length of the crotch so that the snugness or fit of the garment could be adjusted.

It will be also understood that crotch parts 16 need not taper into triangular shaped ends such as tips 24 but may instead be formed of other shapes such as, for example, a shape having a squared off end. Additionally, it will be understood that crotch parts 16 need not be symmetrical and that they may be formed with a relatively wide or relatively narrow base as measured along fold lines 22.

Figure 4:
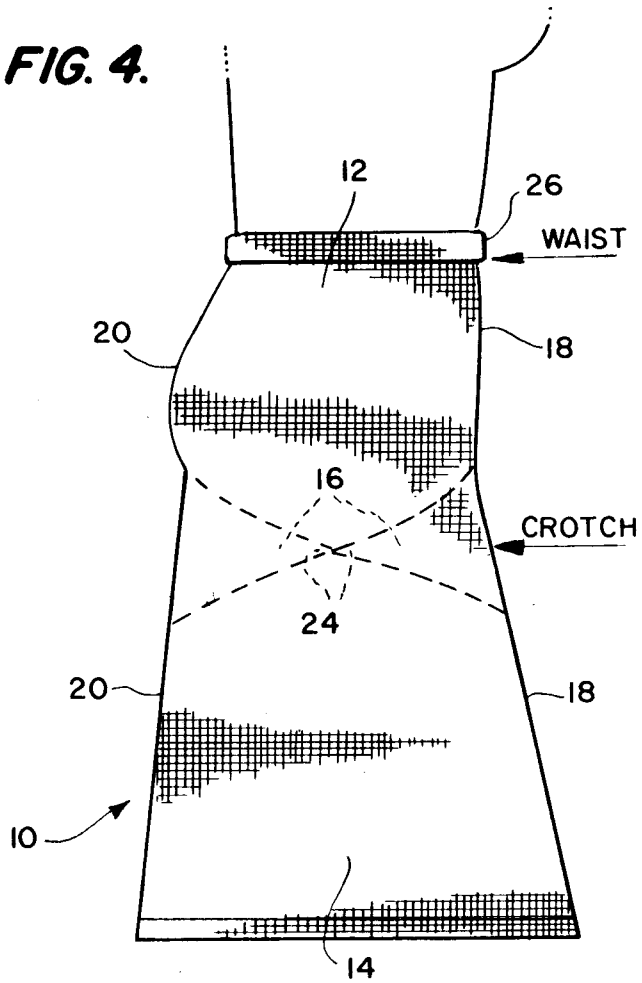
FIG. 4 is a side perspective view of a garment of the present invention, as it would be worn by a wearer.

FIG. 4 illustrates a garment formed by two connected garment halves 10. Crotch parts 16 are shown in dotted lines with their tips 24 adjacent one another. As can be seen, skirt portion 14 broadens outward from the crotch so as to provide a portion having the appearance of a typical skirt. On the other hand, pants portion 12 more closely fits the contours of the wearer in the region of the hips and crotch.

Although the garment as shown in FIG. 4 ends at the waist of the wearer, it will be understood that pants portion 12 can be extended to provide a band of material which can be turned down and sewn along its edge to form a channel 26 for a belt or sash. Also, additional fabric can be attached to or formed integral with pants portion 12 so that the upper part of a dress can be formed, such as garment 30 shown in FIGS. 1 and 2.

Modifications to the garment half 10 to form either a combination pant and skirt garment or a combination pant and dress garment can be easily accomplished. In either a dress or a skirt type garment, the construction of the pants portion will serve as the outer garment in that region of the wearer; in other words, no fabrics will overlie the pants portion. Thus, the garment of the present invention will have a portion extending from the waist to the crotch which resembles pants and a portion below the crotch resembling a skirt or dress portion portion which encircles both legs together.

It will be understood that the garment of this invention could be constructed in one piece by knitting.

The garment of this invention could be an undergarment, serving as a combination of slip and underpants to be worn under either an outer garment of this invention or a conventional skirt.

The advantages of the present invention will be readily apparent. A wearer of the garment of the present invention has greater freedom of movement and need not be concerned with the position of the legs when seated or lying down or other actions which would ordinarily expose the crotch.

Although the invention has been described with respect to certain embodiments, it is to be understood that modifications and variations can be made without departing from the spirit and scope of the invention.

What is claimed is:

1. A garment comprising:

a first portion extending upward from the crotch comprising a crotch section which passes between the legs of the wearer when the garment is worn; and a second portion connected to said first portion and adapted to encircle the legs of the wearer when the garment is worn, whereby said first and second portions are adapted to serve as the outermost material of the garment, so that the garment has a pant-like appearance above the crotch and a skirt-like appearance below the crotch, said first and second portions being formed from two side panels attached together along a front seam line and a rear seam line, each said side panel having two protrusions extending, respectively, from the front and back of the garment toward each other, said protrusions being attached to each other to form the crotch section of said garment.

2. A garment as claimed in claim 1 wherein said second portion defines a single, unbroken interior in which both legs of the wearer are accomodated.

3. A garment as claimed in claim 1 wherein said first portion extends above the waist and the portion extending above the waist serves as an outermost material of the garment to give a dresslike appearance.

4. A garment as claimed in claim 1 wherein the garment is formed from two pieces of material, each of said pieces of material comprising one of said side panels and each of said side panels comprising half of said first portion and half of said second portion.

5. A garment as claimed in claim 1, wherein said two protrusions of each of said pieces of material are generally triangular in shape.

6. A garment as claimed in claim 1 wherein said protrusions are connected by thread.

7. A garment as claimed in claim 1 wherein said first portion further comprises a channel formed from downwardly turned material.

8. A garment as claimed in claim 1 wherein said second portion extends to a hemline in the region of the knees of the wearer.

9. A garment as claimed in claim 1 wherein said second portion extends to a hemline slightly below the crotch and above the knees of the wearer.

10. A garment as claimed in claim 1 intended to be worn as an undergarment.

* * * * *